US010901335B2

(12) United States Patent
Chiba

(10) Patent No.: US 10,901,335 B2
(45) Date of Patent: Jan. 26, 2021

(54) TONER FOR DEVELOPING ELECTROSTATIC IMAGES

(71) Applicant: ZEON CORPORATION, Tokyo (JP)

(72) Inventor: Takeru Chiba, Tokyo (JP)

(73) Assignee: ZEON CORPORATION, Tokyo (JP)

( * ) Notice: Subject to any disclaimer, the term of this patent is extended or adjusted under 35 U.S.C. 154(b) by 0 days.

(21) Appl. No.: 16/648,367

(22) PCT Filed: Sep. 26, 2018

(86) PCT No.: PCT/JP2018/035674
§ 371 (c)(1),
(2) Date: Mar. 18, 2020

(87) PCT Pub. No.: WO2019/065730
PCT Pub. Date: Apr. 4, 2019

(65) Prior Publication Data

US 2020/0225597 A1 Jul. 16, 2020

(30) Foreign Application Priority Data

Sep. 28, 2017 (JP) ..... 2017-188965

(51) Int. Cl.

| | |
|---|---|
| ***G03G 9/097*** | (2006.01) |
| ***G03G 9/08*** | (2006.01) |
| ***G03G 9/09*** | (2006.01) |
| ***G03G 9/113*** | (2006.01) |

(52) U.S. Cl.
CPC ..... *G03G 9/097* (2013.01); *G03G 9/0819* (2013.01); *G03G 9/0926* (2013.01); *G03G 9/1136* (2013.01)

(58) Field of Classification Search
CPC ..... G03G 9/09708; G03G 9/09716; G03G 9/09725
See application file for complete search history.

(56) References Cited

U.S. PATENT DOCUMENTS

2018/0314174 A1* 11/2018 Komada ..... C09D 133/14

FOREIGN PATENT DOCUMENTS

JP 2008-003481 A 1/2008

OTHER PUBLICATIONS

Notification of Transmittal of Copies of Translation of the International Preliminary Report on Patentabililty (Form PCT/IB/338) issued in counterpart International Application No. PCT/JP2018/035674 dated Apr. 9, 2020 with Forms PCT/IB/373 and PCT/ISA/237 (6 pages).

* cited by examiner

*Primary Examiner* — Peter L Vajda
(74) *Attorney, Agent, or Firm* — Westerman, Hattori, Daniels & Adrian, LLP

(57) ABSTRACT

A toner for developing electrostatic images, comprising colored resin particles that contain a binder resin, a colorant and a charge control agent, and external additives, wherein the external additives contain at least an external additive A and an external additive B; wherein the external additive A is metal oxide particles charged to the same polarity as a polarity of the colored resin particles, with a specific charge amount per unit surface area and a specific number average particle diameter; wherein the external additive B is resin particles charged to the opposite polarity to the polarity of the colored resin particles, with a specific number average particle diameter; and wherein a content of the external additive A and a content of the external additive B are in specific ranges.

5 Claims, No Drawings

TONER FOR DEVELOPING ELECTROSTATIC IMAGES

TECHNICAL FIELD

The present invention relates to a toner for developing electrostatic latent images formed by electrophotography, electrostatic recording, etc. More specifically, the present invention relates to a toner for developing electrostatic images, which is less likely to cause supply aggregation and which is excellent in printing durability.

BACKGROUND ART

In image forming devices such as an electrophotographic device, an electrostatic recording device and an electrostatic printing device, a method for forming a desired image by forming an electrostatic latent image on a photoconductor and developing the image with a toner, is widely used. This method is applied to a copying machine, a printer, a facsimile machine, a multifunctional printer, etc.

For example, in an electrophotographic device using electrophotography, generally, the surface of its photoconductor comprising a photoconductive material is uniformly charged by various kinds of methods; an electrostatic latent image is formed on the photoconductor; the electrostatic latent image is developed using a toner; a toner image thus obtained is transferred to a recording material such as a paper sheet; and then the toner image is fixed by heating, etc., thereby obtaining a copy.

As the toner used in image forming devices, a toner comprising colored resin particles (toner base particles) is generally used, in which an external additive such as inorganic or organic fine particles having a smaller particle diameter than the toner base particles, is added on the surface of the toner base particles in order to enhance toner functions such as charge stability and flowability and to obtain desired printing performance.

Patent Document 1 discloses an electrophotographic toner comprising toner base particles, which contain a binder resin and a colorant, and an external additive, which contains strontium titanate and resin particles. In "Examples" of Patent Document 1, a toner comprising negatively-charged toner base particles and an external additive, which contains positively-charged strontium titanate and positively-charged resin particles, is described.

CITATION LIST

Patent Document 1: Japanese Patent Application Laid-Open No. 2008-003481

SUMMARY OF INVENTION

Technical Problem

However, the inventor of the present invention found that the toner described in "Examples" of Patent Document 1, the toner comprising the colored resin particles and the external additive which contains the strontium titanate charged to the opposite polarity to the polarity of the colored resin particles and the resin particles charged to the opposite polarity to the polarity of the colored resin particles, may be deteriorated in a cartridge during continuous printing, may be aggregated by an additional unused toner supply, and may be ejected from the cartridge. Also, the inventor of the present invention found that the toner may have poor printing durability.

In the present invention, toner aggregation induced by additional toner supply is referred to as "supply aggregation."

The present invention was achieved in light of the above circumstance. An object of the present invention is to provide a toner for developing electrostatic images, which is less likely to cause supply aggregation and which is excellent in printing durability.

Solution to Problem

To achieve the above object, the inventor of the present invention made diligent research and found that the above object can be achieved by a toner comprising colored resin particles and external additives, in which, as the external additives, a specific amount of metal oxide particles are used in combination with a specific amount of resin particles; the metal oxide particles are charged to the same polarity as the polarity of the colored resin particles; the metal oxide particles have a specific charge amount per unit surface area and a specific number average particle diameter; the resin particles are charged to the opposite polarity to the polarity of the colored resin particles; and the resin particles have a specific number average particle diameter.

The present invention was achieved in light of this finding. The present invention provides a toner for developing electrostatic images, comprising colored resin particles that comprise a binder resin, a colorant and a charge control agent, and external additives, wherein the external additives contain at least an external additive A and an external additive B;

wherein the external additive A is metal oxide particles charged to the same polarity as a polarity of the colored resin particles; a ratio of a charge amount per unit surface area of the external additive A to that of the colored resin particles is 0.85 or more; and a number average particle diameter of the metal oxide particles is from 5 nm to 100 nm;

wherein the external additive B is resin particles charged to the opposite polarity to the polarity of the colored resin particles, and a number average particle diameter of the resin particles is from 50 nm to 1000 nm; and wherein, with respect to 100 parts by mass of the colored resin particles, a content of the external additive A is from 0.5 parts by mass to 6.0 parts by mass, and a content of the external additive B is from 0.1 parts by mass to 2.0 parts by mass.

In the toner for developing electrostatic images according to the present invention, the colored resin particles are preferably positively charged.

In the toner for developing electrostatic images according to the present invention, a coverage of the external additive A on the toner is preferably from 20% to 100%.

In the toner for developing electrostatic images according to the present invention, the external additive A is preferably titanate or aluminum oxide.

In the toner for developing electrostatic images according to the present invention, the external additive B is preferably silicone resin particles.

Advantageous Effects of Invention

According to the present invention, the toner for developing electrostatic images, which is less likely to cause supply aggregation and which is excellent in printing durability, is provided.

DESCRIPTION OF EMBODIMENTS

The toner for developing electrostatic images according to the present invention, is a toner for developing electrostatic images, comprising colored resin particles that comprise a binder resin, a colorant and a charge control agent, and external additives, wherein the external additives contain at least an external additive A and an external additive B;

wherein the external additive A is metal oxide particles charged to the same polarity as a polarity of the colored resin particles; a ratio of a charge amount per unit surface area of the external additive A to that of the colored resin particles is 0.85 or more; and a number average particle diameter of the metal oxide particles is from 5 nm to 100 nm;

wherein the external additive B is resin particles charged to the opposite polarity to the polarity of the colored resin particles, and a number average particle diameter of the resin particles is from 50 nm to 1000 nm; and wherein, with respect to 100 parts by mass of the colored resin particles, a content of the external additive A is from 0.5 parts by mass to 6.0 parts by mass, and a content of the external additive B is from 0.1 parts by mass to 2.0 parts by mass.

As described above, the toner for developing electrostatic images according to the present invention (hereinafter, it may be simply referred to as "toner") comprise the colored resin particles and the external additives. In the present invention, generally, the external additives are adhered to or partly embedded in the colored resin particles. Part of the external additives may be detached from the colored resin particles. The external additives constituting the toner of the present invention contain at least the external additive A and the external additive B.

Hereinafter, the external additives, the colored resin particles and the toner of the present invention will be described in detail in this order.

1. External Additives (1) External Additive A

The external additive A contained in the toner of the present invention is metal oxide particles charged to the same polarity as a polarity of the colored resin particles; a ratio of a charge amount per unit surface area of the external additive A to that of the colored resin particles is 0.85 or more; and a number average particle diameter of the metal oxide particles is from 5 nm to 100 nm. A toner which is less likely to cause supply aggregation and which is excellent in printing durability, can be obtained by using the metal oxide particles.

The external additive A are metal oxide particles having a number average particle diameter of from 5 nm to 100 nm. If the number average particle diameter of the external additive A is more than 100 nm, the flowability of the toner may deteriorate, and the solid pattern followability of the toner may be impaired. If the number average particle diameter of the external additive A is less than 5 nm, the production of the metal oxide particles is difficult. In addition, since the metal oxide particles used as the external additive A heavily aggregate to each other, it may be difficult to uniformly add the external additive A on the toner surface in an external addition process.

The number average particle diameter of the external additive A is preferably from 10 nm to 70 nm, more preferably from 12 nm to 45 nm, and still more preferably from 15 nm to 45 nm.

In the present invention, the number average particle diameters of the external additives can be measured by a conventionally known method. For example, they can be measured as follows.

First, the particle diameters of the individual particles of each external additive are measured by means of a transmission electron Microscope (TEM), a scanning electron microscope (SEM) or the like. For each external additive, the particle diameters of at least 30 particles are measured in this manner, and the average is determined as the number average particle diameter of the particles. When it is found by TEM or SEM observation, that the form of the particles is a non-spherical form and the particles have long and short diameters, first, the long and short diameters are measured for each external additive. As just described, for each external additive, the long and short diameters of at least 30 particles are measured, and the averages are determined as the average long and short diameters of the external additive. The total value of the calculated average long and short diameters is divided by 2, and the value thus obtained is determined as the number average particle diameter of the external additive.

As the metal oxide particles used as the external additive A, examples include aluminum oxide, titanium oxide, zinc oxide, tin oxide, cerium oxide, and titanate such as strontium titanate ($SrTiO_3$), calcium titanate ($CaTiO_3$), magnesium titanate ($MgTiO_3$), barium titanate ($BaTiO_3$) and zinc titanate ($ZnTiO_3$). Of them, the external additive A is preferably titanate or aluminum oxide, more preferably titanate, and still more preferably strontium titanate.

In the toner of the present invention, the external additive A is charged to the same polarity as the polarity of the colored resin particles. As described above, by using, as the external additives, the metal oxide particles charged to the same polarity as the polarity of the colored resin particles in combination with the below-described resin particles, the toner of the present invention can be the toner which is less likely to cause supply aggregation and which is excellent in printing durability, compared to conventional toners in which metal oxide particles charged to the opposite polarity to the polarity of colored resin particles are used as an external additive.

The reason why, by using the metal oxide particles charged to the same polarity as the polarity of the colored resin particles as the external additive A, the toner of the present invention can be the toner which is less likely to cause supply aggregation and which is excellent in printing durability, is not clear. However, by using, as an external additive, such metal oxide particles that they are charged to the same polarity as the polarity of the colored resin particles and the surface charge amount value of the metal oxide particles is close to that of the colored resin particles, the thus-obtained toner can be a toner which prevents a decrease in toner charge amount and is excellent in printing durability, even if the external additive is embedded in the toner by stress in continuous printing and the binder resin is integrated with the metal oxide particles. In addition, the reason is thought as follows: since there is not a large change in the toner surface charge amount before and after continuous printing, electrostatic aggregation does not occur even if the toner after continuous printing is mixed with the toner before use, and thus supply aggregation is less likely to occur.

In the toner of the present invention, since the external additive A is charged to the same polarity as the polarity of the colored resin particles, positively charged metal oxide particles are used when the colored resin particles are positively charged, and negatively charged metal oxide particles are used when the colored resin particles are negatively charged.

In the toner of the present invention, the ratio of the charge amount per unit surface area of the external additive A to that of the colored resin particles is 0.85 or more. When the ratio of the charge amount per unit surface area of the external additive A to that of the colored resin particles is less than 0.85, even if the external additive A is charged to the same polarity as the polarity of the colored resin particles, the charge amount of the external additive A is low compared to the colored resin particles. If the external additive A is embedded in the colored resin particles in a printing durability test, etc., the charge amount of the toner is largely affected by the charge amount of the embedded external additive A and, as a result, the charge amount of the toner is likely to decrease in a printing durability test. The ratio of the charge amount per unit surface area of the external additive A to that of the colored resin particles is preferably 0.95 or more and 1.9 or less, and more preferably 1.05 or more and 1.5 or less.

The ratio of the charge amount per unit surface area of the external additive A to that of the colored resin particles, is a value obtained by dividing the charge amount per unit surface area of the external additive A, which is obtained as described below, by the charge amount per unit surface area of the colored resin particles, which is obtained as described below.

Charge Amount Per Unit Surface Area (Surface Charge Amount) of External Additive First, 19.98 g of a carrier (product name: N02, manufactured by: Powdertech Corporation) and 0.02 g of the external additive are weighed out and put in a 100 mL polyethylene bottle (inside bottom diameter 23 mm, height 55 mm). The bottle is rotated for 30 minutes at a rotational frequency of 150 rpm by use of a roller mixer. Then, using a blow-off meter (product name: TB-203, manufactured by: Toshiba Chemical Corporation), the blow-off charge amount of the mixture in the bottle is measured by blowing nitrogen gas at a pressure of 2.0 kPa and suctioning the gas at a pressure of 9.5 kPa. The measurement is carried out at a temperature of 23° C. and a relative humidity of 50%.

Using the charge amount (value Q) obtained by the measurement, a charge amount per unit mass (μC/g) is obtained by the following calculation formula 1:

Charge amount per unit mass (μC/g)=Measured charge amount (value *Q*) (μC)/(Total mass (g) of the mixture of the carrier and the external additive×Concentration (% by mass) of the external additive in the mixture of the carrier and the external additive) Calculation formula 1

Using the thus-obtained charge amount per unit mass (μC/g), the charge amount per unit surface area (μC/m$^2$) is obtained by the following calculation formula 2:

Surface charge amount (μC/m$^2$) of the external additive=(Charge amount per unit mass (μC/g))×(Particle diameter (nm) of the external additive×$10^9$/6)×(Density (g/cm$^3$) of the external additive×$10^6$) Calculation formula 2

Charge Amount Per Unit Surface Area (Surface Charge Amount) of Colored Resin Particles First, 9.5 g of a carrier (product name: N02, manufactured by: Powdertech Corporation) and 0.5 g of the colored resin particles are weighed out and put in a 30 mL glass bottle (inside bottom diameter 17 mm, height 22 mm). The bottle is rotated for 30 minutes at a rotational frequency of 150 rpm. Then, using the blow-off meter (product name: TB-203, manufactured by: Toshiba Chemical Corporation), the blow-off charge amount of the mixture in the bottle is measured by blowing nitrogen gas at a pressure of 2.0 kPa and suctioning the gas at a pressure of 9.5 kPa. The measurement is carried out at a temperature of 23° C. and a relative humidity of 50%.

Using the charge amount (value Q) (μC/g) obtained by the measurement, a charge amount per unit mass is obtained by the following calculation formula 3:

Charge amount per unit mass (μC/g)=Measured charge amount (μC) (value *Q*)/(Total mass (g) of the mixture of the carrier and the colored resin particles×Concentration (% by mass) of the colored resin particles in the mixture of the carrier and the colored resin particles) Calculation formula 3

Using the thus-obtained charge amount per unit mass (μC/g), the charge amount per unit surface area (μC/m$^2$) is obtained by the following calculation formula 4:

Surface charge amount (μC/m$^2$) of the colored resin particles=(Charge amount per unit mass (μC/g))×(Particle diameter (μm) of the colored resin particles×$10^6$/6)×(Density (g/cm$^3$) of the colored resin particles×$10^6$) Calculation formula 4

The metal oxide particles used as the external additive A are preferably metal oxide particles surface-hydrophobized with at least one hydrophobizing agent selected from the group consisting of a hydrophobizing agent containing an amino group, a silane coupling agent and a silicone oil. This is because it is easy to control the charge amount of the external additive. In the present invention, a phrase such as being surface-hydrophobized with hydrophobizing agent, is used to show the state of the surface and to specify such a property that the surface of the metal oxide particles is hydrophobic.

As the hydrophobizing agent containing the amino group, examples include a silicon compound containing an amino group.

The silicon compound containing the amino group is not limited to a particular compound, and various kinds of compounds can be used. Examples include an amino group-containing silane coupling agent, an amino-modified silicone oil, a quaternary ammonium salt type silane, and a cyclic silazane represented by the following formula (1). Of them, the amino group-containing silane coupling agent and the cyclic silazane represented by the following formula (1) are particularly preferred from the viewpoint of positively charging ability and flowability. As the amino group-containing silane coupling agent, specific examples include N-2(aminoethyl)3-aminopropylmethyldimethoxysilane, N-2(aminoethyl)3-aminopropyltrimethoxysilane, 3-aminopropyltrimethoxysilane, 3-aminopropyltriethoxysilane, and N-phenyl-3-aminopropyltriethoxysilane. Of such coupling agents, the coupling agent containing the aminoalkyl group is preferred from the viewpoint of an excellent effect to enhance a stability of a charging performance to an environmental influence.

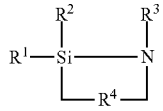

(1)

In the formula (1), $R^1$ and $R^2$ are independently selected from the group consisting of hydrogen, halogen, alkyl, alkoxy and aryloxy; $R^3$ is selected from the group consisting of hydrogen, —$(CH_2)_nCH_3$, —$C(O)(CH_2)_nCH_3$, —$C(O)NH_2$, —$C(O)NH(CH_2)_nCH_3$ and —$C(O)N[(CH_2)_nCH_3](CH_2)_mCH_3$ (where n and m are each an integer of from 0 to 3); and $R^4$ is represented by $[(CH_2)_a(CHX)_b(CHY)_c]$ (where X and Y are independently selected from the group consisting of hydrogen, halogen, alkyl, alkoxy and aryloxy, and a, b and c are each an integer of from 0 to 6 which satisfies such a condition that the sum of a, b and c (a+b+c) is equal to an integer of from 2 to 6).

As the silane coupling agent (except one containing an amino group), examples include disilazanes such as hexamethyldisilazane, and alkylsilane compounds such as trimethylsilane, trimethylchlorosilane, dimethyldichlorosilane, methyltrichlorosilane, allyldimethylchlorosilane, benzyldimethylchlorosilane, methyltrimethoxysilane, methyltriethoxysilane, isobutyltrimethoxysilane, dimethyldimethoxysilane, dimethyldiethoxysilane, trimethylmethoxysilane, hydroxypropyltrimethoxysilane, phenyltrimethoxysilane, n-butyltrimethoxysilane, n-hexadecyltrimethoxysilane, n-octadecyltrimethoxysilane, vinyltrimethoxysilane, vinyltriethoxysilane, γ-methacryloxypropyltrimethoxysilane, and vinyltriacetoxysilane.

These silane coupling agents may be used alone or in combination of two or more kinds. Of the silane coupling agents, hexamethyldisilazane (HMDS) is preferred.

As the silicone oil (except one containing an amino group), examples include dimethylpolysiloxane, methylhydrogenpolysiloxane, methylphenylpolysiloxane, and modified silicone oil.

As described above, for the hydrophobized metal oxide particles being surface-hydrophobized with the hydrophobizing agent, the hydrophobicity measured by a methanol method is generally from 30% to 98%, preferably from 50% to 95%, and more preferably from 60% to 90%. When the hydrophobicity is smaller than 30%, there is a large influence by the environment. Especially, a decrease in charge occurs at high temperature and high humidity and may easily cause fogging. On the other hand, when the hydrophobicity is larger than 98%, an increase in charge occurs at low temperature and low humidity and may cause a decrease in image density.

In the toner of the present invention, the content of the metal oxide particles used as the external additive A, is from 0.5 parts by mass to 6.0 parts by mass, preferably from 0.8 parts by mass to 5.0 parts by mass, and more preferably from 1.2 parts by mass to 3.8 parts by mass, with respect to 100 parts by mass of the colored resin particles. When the content of the external additive A is below the range, the amount of the external additive covering the toner surface is small, and the flowability of the toner may be impaired. On the other hand, when the content of the external additive A is above the range, since the amount of the external additive is too large, the minimum fixing temperature of the toner is increased, and the external additive is likely to be released from the toner surface. Accordingly, charge stability may be impaired in the printing durability test, or supply ejection may occur after the printing durability test.

(2) External Additive B

The external additive B is resin particles charged to the opposite polarity to the polarity of the colored resin particles, and a number average particle diameter of the resin particles is from 50 nm to 1000 nm. By using such resin particles as the external additive B in combination with the above-described external additive A, the toner which is less likely to cause supply aggregation and which is excellent in printing durability, can be obtained.

In the toner of the present invention, the external additive B is charged to the opposite polarity to the polarity of the colored resin particles. As descried above, by using the external additive B (the resin particles charged to the opposite polarity to the polarity of the colored resin particles) in combination with the external additive A, the thus-obtained toner can be the toner which is less likely to cause supply aggregation and which is excellent in printing durability.

In the toner of the present invention, since the external additive B is charged to the opposite polarity to the polarity of the colored resin particles, negatively charged resin particles are used when the colored resin particles are positively charged, and positively charged resin particles are used when the colored resin particles are negatively charged.

The external additive B is resin particles having a number average particle diameter of from 50 nm to 1000 nm. If the number average particle diameter is more than 1000 nm, the specific surface area of the external additive B is small, and the external additive B may fail to function as an external additive. If the number average particle diameter is less than 50 nm, since the specific surface area of the external additive B is large, the external additive B is strongly charged to the opposite polarity to the polarity of the colored resin particles, and supply solid pattern followability or supply ejection may be deteriorated. The number average particle diameter of the external additive B is preferably from 80 nm to 500 nm, and more preferably from 90 nm to 130 nm.

In the present invention, solid pattern followability and toner ejection in the case of additionally supplying a toner are referred to as "supply solid pattern followability" and "supply ejection" respectively.

In the present invention, the content of the external additive B is from 0.1 parts by mass to 2.0 parts by mass, preferably from 0.15 parts by mass to 0.9 parts by mass, and more preferably from 0.2 parts by mass to 0.5 parts by mass, with respect to 100 parts by mass of the colored resin particles. When the content of the external additive B is below the range, since the number of the added particles is small, the external additive B may fail to function as an external additive. On the other hand, when the content of the external additive B is above the range, the external additive B is strongly charged to the opposite polarity to the polarity of the colored resin particles, and supply solid pattern followability or supply ejection may be deteriorated.

As the resin particles used as the external additive B, examples include, but are not limited to, silicone resin particles, methacrylic acid ester polymer particles, acrylic acid ester polymer particles, styrene-methacrylic acid ester copolymer particles, styrene-acrylic acid ester copolymer particles, core-shell type particles in which the core is formed with a styrene polymer and the shell is formed with a methacrylic acid ester polymer, fluorine resin, and melamine resin particles. Of them, the resin particles used as the external additive B are preferably silicone resin particles.

In the toner of the present invention, the ratio of the charge amount per unit surface area of the external additive B to that of the toner is preferably from −1.5 to −0.05. When the ratio of the charge amount per unit surface area of the external additive B to that of the toner is less than −1.5, the external additive B is strongly charged to the opposite polarity to the polarity of the colored resin particles, and supply solid pattern followability or supply ejection may be deteriorated. When the ratio is more than −0.05, the external additive B does not contact with the toner or the external additive A and is not charged. Accordingly, the external additive B may be ineffective in assisting toner charging. The ratio of the charge amount per unit surface area of the external additive B to that of the toner is preferably from −1.0 to −0.10, and more preferably from −0.50 to −0.15.

For the silicone resin particles that are preferably used as the external additive B, the ratio (hereinafter it may be simply referred to as BS/TS ratio) of a BET specific surface area (BS) per unit mass, which is measured by a gas adsorption method, to a theoretical specific surface area (TS) per unit mass, which is obtained by calculating from a number average particle diameter measured by scanning electron microscope (SEM) observation on a theoretical calculation formula, is preferably in a range of from 3.0 to 30.0, more preferably in a range of from 3.5 to 25.0, and still more preferably in a range of from 4.0 to 20.0.

In the present invention, the BS/TS ratio is used as the indicator of the porosity of the silicone resin particles preferably used as the external additive B. By the theoretical specific surface area (TS), the surface roughness of the particles cannot be evaluated; however, the surface roughness can be evaluated by the BET specific surface area (BS). Therefore, when the BS/TS ratio is high, the particles can be evaluated as particles having a high porosity. On the other hand, when the BS/TS ratio gets closer to 1, the particles can be evaluated as particles having a small porosity.

When the BS/TS ratio is below the range, toner ejection is likely to occur. On the other hand, when the BS/TS ratio is above the range, the production of the silicone resin particles may be difficult.

In the present invention, for the silicone resin particles preferably used as the external additive B, the theoretical specific surface area (TS) per unit mass is calculated by the theoretical calculation formula and from the number average particle diameter measured by, among the above-mentioned number average particle diameter measuring methods, scanning electron microscope (SEM) observation.

That is, assuming that the silicone resin particles preferably used in the present invention are in spherical form (irrespective of the actual form), the theoretical specific surface area (TS) per unit mass is obtained by the following theoretical calculation formula 5 that is used to obtain the specific surface area per unit mass of a sphere.

Theoretical specific surface area TS ($m^2/g$)=6/(Average density ($g/cm^3$)×Number average particle diameter (nm)×$10^3$) Calculation formula 5

The method for obtaining the average density is not particularly limited, and a conventionally known method can be used.

The BET specific surface area (BS) per unit mass measured by the gas adsorption method, can be obtained by a method for measuring the amount of a monolayer of nitrogen gas adsorbed on the silicone resin particle surface with the use of the formula of BET.

To measure the BET specific surface area (BS) of the silicone resin particles preferably used as the external additive B, a conventionally known method can be used. As the method for measuring the BET specific surface area (BS) of the silicone resin particles, examples include a method for measuring in accordance with a nitrogen adsorption method (a BET method) using a BET specific surface area measuring device (product name: MACSORB HM MODEL-1208, manufactured by: Mountech Co., Ltd.), etc.

The water adsorption amount of the external additive B preferably used in the present invention, is preferably 1.0% by mass or less, more preferably 0.6% by mass or less, and still more preferably 0.35% by mass or less. When the water adsorption amount of the external additive B is more than 1.0% by mass, fogging may be caused by a decrease in charge amount at high temperature and high humidity.

The silicone resin particles preferably used as the external additive B are preferably surface-hydrophobized with a hydrophobizing agent such as a silane coupling agent. The type of the hydrophobizing agent is not particularly limited. For example, the hydrophobizing agent described in relation to the external additive A, can be used.

The form of the silicone resin particles preferably used as the external additive B, is not particularly limited and may be an irregular form. The form is preferably a spherical form.

For the silicone resin particles preferably used as the external additive B, the sphericity (Sc/Sr) is preferably from 0.970 to 1.000, and more preferably from 0.985 to 1.000.

When the sphericity (Sc/Sr) of the silicone resin particles preferably used as the external additive B is out of the range, the toner thus obtained is poor in thin line reproducibility.

In the present invention, the sphericity is defined as a value obtained by dividing the area (Sc) of a circle having the absolute maximum length of the particle as its diameter, by the substantial projected area (Sr) of the particle.

The sphericity (Sc/Sr) of the silicone resin particles used as the external additive B, is a value obtained as follows: a photograph of the silicone resin particles taken by an electron microscope, is analyzed for Sc and Sr by an image analyzer; the sphericity (Sc/Sr) of each particle is calculated; and the thus-obtained sphericities of the particles are averaged, thereby obtaining the sphericity (Sc/Sr) of the silicone resin particles.

To measure the sphericity of the external additive B, a conventionally known method can be used. As the method for measuring the sphericity of the external additive B, examples include the following method: an electron micrograph of the external additive B is taken, and the electron micrograph is measured by an image analyzer (product name: LUZEX IID, manufactured by: Nireco Corporation), thereby measuring the sphericity of the external additive B.

(3) Another External Additive

In the present invention, in addition to the external additives A and B, an external additive that has been conventionally used in toners may be further contained. As such an external additive, examples include inorganic fine particles not corresponding to the external additive A and organic fine particles not corresponding to the external additive B. As the inorganic fine particles, examples include silica, silicon nitride, calcium carbonate and calcium phosphate. As the organic fine particles, examples include acrylic particles, melamine resin particles, silicone polymer particles and Teflon (trade name) resin particles.

2. Colored Resin Particles

The colored resin particles constituting the toner of the present invention are particles that comprise at least a binder resin, a colorant and a charge control agent. Preferably, the colored resin particles further contain a release agent. As needed, the colored resin particles may further contain a magnetic material, etc.

As the binder resin, examples include resins that have been widely used in toners, such as polystyrene, styrene-butyl acrylate copolymer, polyester resin and epoxy resin.

As the colorant, examples include carbon black, titanium black, magnetic powder, oil black, titanium white, and all kinds of colorants and dyes. As the carbon black, one having a primary particle diameter of from 20 nm to 40 nm is preferably used. This is because, since the particle diameter is in this range, the carbon black can be uniformly dispersed in the toner, and fogging is less likely to occur.

To obtain a full color toner, a yellow colorant, a magenta colorant and a cyan colorant are generally used.

As the yellow colorant, examples include compounds such as an azo-based colorant and a condensed polycyclic colorant. As the compounds, examples include C.I. Pigment Yellow 3, 12, 13, 14, 15, 17, 62, 65, 73, 83, 90, 93, 97, 120, 138, 155, 180, 181, 185 and 186.

As the magenta colorant, examples include compounds such as an azo-based colorant and a condensed polycyclic colorant. As the compounds, examples include C.I. Pigment Red 31, 48, 57, 58, 60, 63, 64, 68, 81, 83, 87, 88, 89, 90, 112, 114, 122, 123, 144, 146, 149, 150, 163, 170, 184, 185, 187, 202, 206, 207, 209 and 251, and C.I. Pigment Violet 19.

As the cyan colorant, examples include a copper phthalocyanine compound and derivatives thereof, and an anthraquinone compound. As the compounds and derivatives, examples include C.I. Pigment Blue 2, 3, 6, 15, 15:1, 15:2, 15:3, 15:4, 16, 17 and 60.

The amount of the colorant is preferably from 1 part by mass to 10 parts by mass, with respect to 100 parts by mass of the binder resin.

The colored resin particles constituting the toner of the present invention contain a charge control agent. As the charge control agent, charge control agents that have been used in toners can be used without any particular limitation. In the present invention, since the colored resin particles are preferably positively charged, a positively-chargeable charge control agent is preferably used.

Of the charge control agents, a charge control resin is preferably used due to the following reasons: the charge control resin has high compatibility with binder resin; the charge control resin is colorless; and a toner that are stably charged during high-speed color continuous printing, can be obtained. As the charge control resin, the following charge control resins can be used: positively-chargeable charge control resins such as quaternary ammonium (salt) group-containing copolymers produced in accordance with the descriptions in Japanese Patent Application Laid-Open (JP-A) Nos. S63-60458, H03-175456, H03-243954 and H11-15192, and negatively-chargeable charge control resins such as sulfonic acid (salt) group-containing copolymers produced in accordance with the descriptions in JP-A Nos. H01-217464 and H03-15858. In the present invention, as described above, since the colored resin particles are preferably positively charged, a positively-chargeable charge control resin is preferably used.

The amount of a monomer unit having a quaternary ammonium (salt) group or sulfonic acid (salt) group contained in the copolymers, is preferably from 0.5% by mass to 15% by mass, and more preferably from 1% by mass to 10% by mass. When the content is in the range, it is easy to control the charge amount of the toner, and fogging is less likely to occur.

The weight average molecular weight of the charge control resin is preferably from 2,000 to 50,000, more preferably from 4,000 to 40,000, and most preferably from 6,000 to 35,000. When the weight average molecular weight of the charge control resin is less than 2,000, toner offset may occur. On the other hand, when the weight average molecular weight is more than 50,000, the toner may deteriorate fixability.

The glass transition temperature of the charge control resin is preferably from 40° C. to 80° C., more preferably from 45° C. to 75° C., and most preferably from 45° C. to 70° C. When the glass transition temperature is less than 40° C., the toner may deteriorate storage stability. When the glass transition temperature is more than 80° C., the toner may deteriorate fixability.

The amount of the charge control agent is generally from 0.01 parts by mass to 30 parts by mass, and preferably from 0.3 parts by mass to 25 parts by mass, with respect to 100 parts by mass of the binder resin.

As the release agent preferably contained in the colored resin particles constituting the toner of the present invention, examples include polyolefin waxes such as low-molecular-weight polyethylene, low-molecular-weight polypropylene and low-molecular-weight polybutylene; natural plant waxes such as candelilla wax, carnauba wax, rice wax, Japan wax and jojoba wax; petroleum waxes and modified waxes thereof, such as paraffin wax, microcrystalline wax, and petrolatum; synthetic waxes such as Fischer-Tropsch wax; and ester compounds such as pentaerythritol tetramyristate, pentaerythritol tetrapalmitate, behenyl behenate, and dipentaerythritol hexamyristate.

These release agents may be used alone or in combination of two or more kinds.

Of these release agents, the synthetic waxes and the ester compounds are preferred. Of them, preferred is such an ester compound that in a DSC curve measured by a differential scanning calorimeter, the endothermic peak temperature in temperature rising is in a range of preferably from 30° C. to 150° C., more preferably from 40° C. to 100° C., and most preferably from 50° C. to 80° C. This is because a toner with an excellent balance between fixability and releasability can be obtained. More preferred is an ester compound which has a molecular weight of 1,000 or more, which is dissolved in an amount of 5 parts by mass or more at 25° C. with respect to 100 parts by mass of styrene, and which has an acid value of 10 mgKOH/g or less. This is because such an ester compound is remarkably effective in lowering toner fixing temperature. The ester compound is preferably a monoester compound, and more preferably behenyl behenate. The "endothermic peak temperature" means a value measured in accordance with ASTM D 3418-82.

The amount of the release agent is generally from 3 parts by mass to 20 parts by mass, and preferably from 5 parts by mass to 15 parts by mass, with respect to 100 parts by mass of the binder resin.

The colored resin particles may be so-called core-shell type (or "capsule type") particles obtained by combining two different polymers as the inside (core layer) and outside (shell layer) of the particles. The core-shell type particles are preferred since they can achieve a balance between lowering of fixing temperature and prevention of aggregation during storage by covering the inside (core layer) composed of a substance having a low softening point with a substance having a higher softening point.

In general, the core layer of the core-shell type particles is composed of the binder resin, the colorant, the charge control agent and the release agent, and the shell layer thereof is composed of only the binder resin.

The mass ratio of the core layer to the shell layer of the core-shell type particles is not particularly limited. It is generally from 80/20 to 99.9/0.1 (the core layer/the shell layer).

By controlling the shell layer ratio to the above ratio, the toner can obtain both storage stability and low-temperature fixability.

The average thickness of the shell layers of the core-shell type particles is considered to be generally from 0.001 μm to 0.1 μm, preferably from 0.003 μm to 0.08 μm, and more preferably from 0.005 μm to 0.05 μm. As the thickness increases, the fixability of the toner may decrease. As the thickness decreases, the storage stability of the toner may decrease.

When the colored resin particles are core-shell type particles, the surface of the core particles constituting the core-shell colored resin particles, is not needed to be wholly covered with the shell layer. The surface of the core particles may be partly covered with the shell layer.

For the core-shell type particles, when the core particle diameter and the shell layer thickness can be observed with an electron microscope, they can be determined by randomly selecting a particle from particles shown in a photograph taken by the electron microscope and directly measuring the size of a particle and the thickness of the shell layer of the same particle. When it is difficult to observe the core and shell with the electron microscope, the core particle diameter and the shell layer thickness can be calculated from the particle diameter of the core particle and the amount of a monomer used to form the shell in toner production.

For the colored resin particles constituting the toner of the present invention, the volume average particle diameter (Dv) is preferably from 3 μm to 10 μm, and more preferably from 4 μm to 8 μm. When the Dv is less than 3 μm, toner flowability decreases, and the decreased toner flowability may decrease transferability, cause blur, or decrease image density. When the Dv is more than 10 μm, image resolution may decrease.

For the colored resin particles constituting the toner of the present invention, the ratio (Dv/Dn) between the volume average particle diameter (Dv) and the number average particle diameter (Dn) is preferably from 1.00 to 1.30, and more preferably from 1.00 to 1.20. When the ratio Dv/Dn is more than 1.30, blur or a decrease in transferability, image density and resolution may occur.

The volume average particle diameter and number average particle diameter of the colored resin particles and those of the toner can be measured by means of particle size analyzer MULTISIZER (product name, manufactured by Beckman Coulter, Inc.), for example.

For the colored resin particles constituting the toner of the present invention, the average circularity is preferably from 0.940 to 0.995, and more preferably from 0.950 to 0.990. When the average circularity is less than 0.940, a decrease in transferability may occur.

The average circularity can be relatively easily controlled in the above-described range by employing a production method such as a phase inversion emulsion method, a solution suspension method and a polymerization method.

In the present invention, "circularity" is defined as a value obtained by dividing the perimeter of a circle having the same area as the projected area of a particle image by the perimeter of the projected image of the particle. Also in the present invention, "average circularity" is used as a simple method for quantitatively representing the shape of the particles and is the indicator of the degree of the surface roughness of the toner. The average circularity is 1 when the toner is perfectly spherical, and it gets smaller as the surface shape of the colored resin particles becomes more complex.

The average circularity (Ca) is a value obtained by the following calculation formula 6:

$$\text{Average Circularity}(Ca) = \left(\sum_{i=1}^{n}(Ci \times fi)\right) \Big/ \sum_{i=1}^{n}(fi) \qquad \text{Calculation Formula 6}$$

In the above formula, n is the number of particles for each of which the circularity Ci is obtained.

In the above formula, Ci is the circularity of each of particles having an equivalent circle diameter of from 0.6 μm to 400 μm and is calculated by the following calculation formula 7 based on the perimeter measured for each particle:

Circularity (Ci)=(Perimeter of a circle having the same area as the projected area of a particle image)/(Perimeter of the projected particle image) Calculation Formula 7

In the above formula, fi is the frequency of the particles having the circularity Ci.

The circularity and the average circularity can be measured by means of flow particle image analyzer "FPIA-3000" (product name, manufactured by: Sysmex Corporation).

3. Method for Producing the Colored Resin Particles

The method for producing the colored resin particles is not particularly limited. The polymerization method is preferred since the above-described circularity can be easily obtained.

Next, the method for producing the colored resin particles by the polymerization method will be described in detail. The colored resin particles constituting the toner of the present invention can be obtained as follows: the colorant, the charge control agent and other additives are dissolved or dispersed in a polymerizable monomer, which is a raw material for the binder resin; in an aqueous dispersion medium containing a dispersion stabilizer, the thus-obtained mixture or dispersion is polymerized by adding a polymerization initiator thereto and, as needed, particles thus produced are associated with each other; then, the particles are recovered from the mixture by filtration, washed, dehydrated and then dried, thereby producing the colored resin particles.

As the polymerizable monomer, examples include a monovinyl monomer, a crosslinkable monomer and a macromonomer. The polymerizable monomer is polymerized into a binder resin component.

As the monovinyl monomer, examples include aromatic vinyl monomers such as styrene, vinyltoluene and α-methylstyrene; (meth)acrylic acid; (meth)acrylic copolymers such as methyl (meth)acrylate, ethyl (meth)acrylate, propyl (meth)acrylate, butyl (meth)acrylate, 2-ethylhexyl (meth) acrylate, cyclohexyl (meth)acrylate, and isobornyl (meth) acrylate; and monoolefin monomers such as ethylene, propylene and butylene.

These monovinyl monomers may be used alone or in combination of two or more kinds. Of them, it is preferable to use the aromatic vinyl monomer alone or to use a combination of the aromatic vinyl monomer and the (meth) acrylic monomer.

Hot offset is effectively reduced by using a crosslinkable monomer in combination with the monovinyl monomer. The crosslinkable monomer is a monomer containing two or more vinyl groups. As the crosslinkable monomer, examples include divinylbenzene, divinylnaphthalene, ethylene glycol dimethacrylate, pentaerythritol triallyl ether, and trimethylolpropane triacrylate. These crosslinkable monomers may be used alone or in combination of two or more kinds. The amount of the crosslinkable monomer is generally 10 parts by mass or less, and preferably from 0.1 parts by mass to 2 parts by mass, with respect to 100 parts by mass of the monovinyl monomer.

Also, it is preferable to use a macromonomer in combination with the monovinyl monomer, since the balance between the storage stability and low-temperature fixability can be excellent. The macromonomer is an oligomer or polymer having a polymerizable carbon-carbon unsaturated double bond at the end of a polymer chain and generally having a number average molecular weight of from 1,000 to 30,000.

The macromonomer is preferably if the macromonomer can provide a polymer having a higher glass transition temperature than a polymer obtained by polymerizing the monovinyl monomer.

The amount of the macromonomer is generally from 0.01 parts by mass to 10 parts by mass, preferably from 0.03 parts by mass to 5 parts by mass, and more preferably from 0.05 parts by mass to 1 part by mass, with respect to 100 parts by mass of the monovinyl monomer.

As the polymerization initiator, examples include persulfates such as potassium persulfate and ammonium persulfate; azo compounds such as 4,4'-azobis(4-cyanovaleric acid), 2,2'-azobis(2-methyl-N-(2-hydroxyethyl)propionamide), 2,2'-azobis(2-amidinopropane)dihydrochloride, 2,2'-azobis(2,4-dimethylvaleronitrile) and 2,2'-azobisisobutyronitrile; and peroxides such as di-t-butyl peroxide, benzoyl peroxide, t-butylperoxy-2-ethylhexanoate, t-hexylperoxy-2-ethylhexanoate, t-butyl peroxypivalate, di-isopropyl peroxydicarbonate, di-t-butylperoxy isophthalate, and t-butylperoxy isobutyrate. Also, a redox initiator (a combination of the polymerization initiator with a reducing agent) may be used.

The amount of the polymerization initiator used for the polymerization of the polymerizable monomer is preferably from 0.1 parts by mass to 20 parts by mass, more preferably from 0.3 parts by mass to 15 parts by mass, and most preferably from 0.5 parts by mass to 10 parts by mass, with respect to 100 parts by mass of the polymerizable monomer. The polymerization initiator may be added to a polymerizable monomer composition in advance or, in some cases, the polymerization initiator may be added to the aqueous dispersion medium in a state after being subjected to droplets formation.

In the polymerization, a dispersion stabilizer is preferably added to the aqueous dispersion medium. As the dispersion stabilizer, examples include metal compounds including sulfates such as barium sulfate and calcium sulfate, carbonates such as barium carbonate, calcium carbonate and magnesium carbonate, phosphates such as calcium phosphate, metal oxides such as aluminum oxide and titanium oxide, and metal hydroxides such as aluminum hydroxide, magnesium hydroxide and iron(II)hydroxide; water-soluble polymers such as polyvinyl alcohol, methyl cellulose and gelatin; and surfactants such as an anionic surfactant, a nonionic surfactant and an ampholytic surfactant. These dispersion stabilizers may be used alone or in combination of two or more kinds.

The amount of the dispersion stabilizer is preferably from 0.1 parts by mass to 20 parts by mass, with respect to 100 parts by mass of the polymerizable monomer. When the amount of the dispersion stabilizer is less than 0.1 parts by mass, it is difficult to obtain sufficient polymerization stability, and a polymer aggregate may easily generate. On the other hand, when the amount of the dispersion stabilizer is more than 20 parts by mass, the particle diameter of the polymerized toner may become too small and become unsuitable for practical use.

It is preferable to use a molecular weight modifier in the polymerization. As the molecular weight modifier, examples include mercaptans such as t-dodecyl mercaptan, n-dodecyl mercaptan, n-octyl mercaptan and 2,2,4,6,6-pentamethylheptane-4-thiol. The molecular weight modifier may be added before or during the polymerization. The amount of the molecular weight modifier is preferably from 0.01 parts by mass to 10 parts by mass, and more preferably from 0.1 parts by mass to 5 parts by mass, with respect to 100 parts by mass of the polymerizable monomer.

The method for producing the above-mentioned, preferred core-shell type colored resin particles is not particularly limited. The core-shell type colored resin particles can be produced by a conventional method. As the method, examples include a spray dry method, an interface reaction method, an in situ polymerization method and a phase separation method. In particular, the core-shell type colored resin particles are obtained as follows: the colored resin particles obtained by a pulverization method, a polymerization method, an association method or a phase inversion emulsion method, are used as the core particles, and they are each covered with a shell layer, thereby obtaining the core-shell type colored resin particles. Of these production methods, the in situ polymerization method and the phase separation method are preferred from the viewpoint of production efficiency.

The in situ polymerization method for producing the capsule type colored resin particles with a core-shell structure will be described below.

The capsule type colored resin particles with a core-shell structure, can be obtained by adding a polymerizable monomer for forming a shell (a polymerizable monomer for shell) and a polymerization initiator to an aqueous dispersion medium in which core particles are dispersed, and then polymerizing the mixture.

As the method for forming the shell, examples include: a method in which the polymerizable monomer for shell is added to a reaction system of a polymerization reaction developed for obtaining the core particles, and a polymerization process is continued; and a method in which core particles obtained in a different reaction system is prepared, the polymerizable monomer for shell is added thereto and a polymerization process is carried out.

The polymerizable monomer for shell may be added to the reaction system at once or may be added continuously or intermittently to the reaction system by means of a pump such as a plunger pump.

As the polymerizable monomer for shell, monomers that can form a polymer having a glass transition temperature of more than 80° C., such as styrene, acrylonitrile and methyl methacrylate, can be used alone or in combination of two or more kinds.

A water-soluble polymerization initiator is preferably added at the time of adding the polymerizable monomer for shell, since the capsule type colored resin particles with a core-shell structure can be easily obtained. By adding the water-soluble polymerization initiator at the time of adding the polymerizable monomer for shell, it is considered that the water-soluble polymerization initiator has moves to the vicinity of the outer surface of the core particles, to which the polymerizable monomer for shell moved, and a polymer (shell) can be easily formed on the core particle surface.

As the water-soluble polymerization initiator, examples include persulfates such as potassium persulfate and ammonium persulfate, and azo-based initiators such as 2,2'-azobis(2-methyl-N-(2-hydroxyethyl)propionamide) and 2,2'-azobis-(2-methyl-N-(1,1-bis(hydroxymethyl)2-hydroxyethyl) propionamide). The amount of the water-soluble polymerization initiator is generally from 0.1 parts by mass to 50 parts by mass, and preferably from 1 part by mass to 30 parts by mass, with respect to 100 parts by mass of the polymerizable monomer for shell.

The polymerization temperature is preferably 50° C. or more, and more preferably from 60° C. to 95° C. The reaction time is preferably from 1 hour to 20 hours, and more preferably from 2 hours to 10 hours. After the polymerization is completed, the colored resin particles obtained by the polymerization is preferably subjected to repeated operations of filtering, washing, dehydrating and drying several times as needed, according to a conventional method.

When an inorganic compound such as an inorganic hydroxide is used as the dispersion stabilizer, preferably, the dispersion stabilizer is dissolved in water by adding acid or alkali to the aqueous dispersion of the colored resin particles obtained by the polymerization, and then the dispersion stabilizer is removed. When a colloid of a hardly water-soluble inorganic hydroxide is used as the dispersion stabilizer, the pH of the aqueous dispersion is preferably controlled to 6.5 or less by adding acid. As the acid, examples include inorganic acids such as sulfuric acid, hydrochloric acid and nitric acid, and organic acids such as formic acid and acetic acid. Sulfuric acid is particularly preferred for its high removal efficiency and small influence on production facilities.

The method for filtering the colored resin particles from the aqueous dispersion medium and dehydrating them is not particularly limited. As the method, examples include a centrifugal filtration method, a vacuum filtration method and a pressure filtration method. Of them, the centrifugal filtration method is preferred.

4. Toner

The toner of the present invention is obtained by mixing the colored resin particles described above in "2. Colored resin particles", the external additive A described above in "(1) External additive A" under "1. External additives", the external additive B described above in "(2) External additive B" under "1. External additives" and, as needed, other fine particles by means of a high-speed mixer such as Henschel Mixer.

The toner of the present invention is preferably positively charged. The reason is as follows. In the present invention, as described above, the colored resin particles are preferably positively charged. Accordingly, when the colored resin particles are positively charged and the external additives A and B are positively and negatively charged in the above range, respectively, the thus-obtained toner particles are positively charged, and the toner thus obtained is a toner for developing electrostatic images, which is less likely to cause supply aggregation and which is excellent in printing durability. The method for measuring the charge amount per unit surface area of the toner will not be described here, since it is the same as the method described above in "1. External additives".

Also in the present invention, the coverage of the external additive A on the toner is preferably from 20% to 100%, and more preferably from 30% to 80%. The coverage of the external additive A on the toner can be obtained by the following calculation formula 8.

Also in the present invention, the coverage of the external additive B on the toner is preferably from 0.5% to 20%, more preferably from 1% to 15%, and still more preferably from 1.5% to 10%. The coverage of the external additive B on the toner can be obtained by the following calculation formula 8.

Coverage (%) of each external additive=$(3^{1/2}/2\pi)\times$(Density (g/cm$^3$) of the colored resin particles/Density (g/cm$^3$) of the external additive)×(Particle diameter (μm) of the colored resin particles/Particle diameter (μm) of the external additive)×(Mass ratio (part by mass) of the external additive with respect to 100 parts by mass of the colored resin particles) Calculation Formula 8

EXAMPLES

Hereinafter, the present invention will be described further in detail, with reference to examples and comparative examples. The scope of the present invention may not be limited to the following examples. Herein, "part(s)" and "%" are based on mass if not particularly mentioned.

In the following examples and comparative examples, methods for measuring and evaluating properties are as follows.

1. Toner Evaluation (1) Printing Durability and Charge Stability During Printing Durability Test (Actual Device Charge Amount Measurement)

In a printing durability test, a commercially-available, non-magnetic one-component development printer was used. The toner was packed into the toner cartridge of the development device. Then, printing sheets were loaded in the device.

The printer was left for 24 hours under a normal-temperature and normal-humidity (N/N) environment (temperature: 23° C., humidity: 50%). Then, under the same environment, 20,000 sheets were continuously printed at an image density of 0% (white solid pattern printing).

Black solid pattern printing (image density 100%) was carried out at every 500th sheets, and the resulting black solid images were measured for image density by means of a reflection image densitometer (product name: RD918, manufactured by: Macbeth). Then, white solid pattern printing (image density 0%) was carried out. When printing halfway, the printer was stopped. A piece of an adhesive tape (product name: SCOTCH MENDING TAPE 810-3-18, manufactured by: Sumitomo 3M Limited) was attached to a non-image area on the photoconductor of the printer after development to make the toner adhere in the area to the tape piece. Then, the tape piece was removed therefrom and attached to a printing sheet. Next, the whiteness degree (B) of the printing sheet on which the tape piece was attached, was measured with a whiteness colorimeter (product name: ND-1, manufactured by: Nippon Denshoku Industries Co., Ltd.) In the same manner, an unused piece of the adhesive tape was attached to the printing sheet, and the whiteness degree (A) was measured. The difference in whiteness degree (B−A) was determined as a fog value. As the fog value gets smaller, fogging decreases and a better result is obtained.

The number of continuously printed sheets that could maintain an image quality with an image density of 1.3 or more and a fog value of 1.0 or less, was measured. The fog value at the time of printing the first sheet was determined as the initial fog value.

The charge stability during the printing durability test was evaluated as follows. In the printing durability test, the charge amount (μC/g) of the toner attached on a developing roller was obtained after the white solid pattern printing was carried out on the 10th sheet and on the 10,010th sheet. Then, the thus-obtained charge amount of the case of printing the 10th sheet was compared to the thus-obtained charge amount of the case of printing the 10,010th sheet, thereby evaluating the charge stability during the printing durability test. In particular, the charge stability during the printing durability test was judged as follows.

Excellent (A): The rate of change in the measured value between the 10th sheet and the 10,010th sheet, was less than 15%.

Relatively excellent (B): The rate of change was 15% or more and less than 30%.

Slightly bad (C): The rate of change was 30% or more and less than 50%.

Very bad (D): The rate of change was 50% or more.

Each charge amount (actual device charge amount) (μC/g) of the toner attached on the developing roller was obtained by the following calculation formula 9, using a measured value obtained by use of a suction type charge amount measuring device (product name: 210HS-2A, manufactured by: TREK JAPAN).

Actual device charge amount (μC/g)=Charge amount (value $Q$) (μC) measured by suction and blow-off/Toner amount (g) suctioned from the developing roller — Calculation Formula 9

(2) Solid Pattern Followability

In the same manner as above, the toner was packed into the toner cartridge of the printer, and the printer was left under a normal-temperature and normal-humidity (N/N) environment for 24 hours. Then, black solid pattern printing (image density 100%) was carried out on 10 sheets. Using a reflection image densitometer (product name: RD918, manufactured by: Macbeth), the image density of a part of the solid pattern printed on the 10th sheet, which is a part downstream 50 mm from the front edge of the pattern, and the image density of another part of the solid pattern printed on the 10th sheet, which is a part upstream 50 mm from the rear edge of the pattern, were measured. The difference in image density between the front and the rear parts was determined as the indicator of solid pattern followability. As the difference between the image densities gets smaller, the solid pattern followability gets better.

(3) Supply Solid Pattern Followability after Printing Durability Test

After the above-mentioned printing durability test, the toner remaining in the toner cartridge was recovered and mixed with the same amount of unused toner as the remaining toner. The mixed toner was packed into the toner cartridge of the development device. The toner cartridge was left under a normal-temperature and normal-humidity (N/N) environment (temperature: 23° C., humidity: 50%) for one day. Then, the supply solid pattern followability after the printing durability test was evaluated in the same manner as the above-described "(2) Solid pattern followability".

(4) Ejection Evaluation

In the same manner as above, the toner was packed into the toner cartridge of the printer, and the printer was left under a normal-temperature and normal-humidity (N/N) environment for 24 hours. Then, continuous printing was carried out.

The continuous printing of 100 sheets was carried out in the condition at an image density of 5% under a normal-temperature and normal-humidity (N/N) environment (temperature: 23° C., humidity: 50%). Then, the toner ejected from the toner cartridge onto the printing paper sheets, was checked and evaluated in accordance with the following evaluation criteria. Of the following criteria, A to C are determined as satisfactory.

[Evaluation Criteria]

A: No ejection occurred

B: Slight ejection that ended during printing of up to 3 sheets

C: Slight ejection that did not end during printing of up to 100 sheets

D: Severe ejection that did not end during printing of up to 100 sheets (5) Evaluation of Supply Ejection after Printing Durability Test After the above-mentioned printing durability test, the toner remaining in the toner cartridge was recovered and mixed with the same amount of unused toner as the remaining toner. The mixed toner was packed into the toner cartridge of the development device. The toner cartridge was left under a normal-temperature and normal-humidity (N/N) environment (temperature: 23° C., humidity: 50%) for one day. Then, continuous printing was carried out.

The continuous printing of 100 sheets was carried out in the condition at an image density of 5% under a normal-temperature and normal-humidity (N/N) environment (temperature: 23° C., humidity: 50%). Then, the toner ejected from the toner cartridge onto the printing paper sheets, was checked and evaluated in accordance with the above evaluation criteria. Of the above criteria, A to C are determined as satisfactory.

(6) Minimum Fixing Temperature

A fixing test was carried out by using a commercially-available, non-magnetic one-component development printer modified so that the temperature of its fixing roll can be varied. The fixing test was carried out by printing a solid black pattern (image density: 100%) and varying the temperature of the fixing roll of the modified printer in steps of 5° C. to measure the fixing rate of the toner at each temperature, thereby finding a relationship between the temperature and the fixing rate. The fixing rate was calculated from the ratio of image densities before and after a peeling operation using a piece of tape, which was carried out on a solid black pattern-printed area (image density: 100%) on a test paper sheet. Specifically, assuming that the image density before the peeling of the tape piece is ID (before), and the image density after the peeling thereof is ID (after), the fixing rate can be calculated by the following Calculation Formula 10:

Fixing rate (%)=(ID (after)/ID (before))×100 — Calculation Formula 10

The peeling operation using the tape is a series of the following operations: a piece of an adhesive tape (product name: SCOTCH MENDING TAPE 810-3-18, manufactured by: Sumitomo 3M Limited) is applied to a measuring area on a test paper sheet; the tape piece is attached to the sheet by pressing the tape piece at a certain pressure; and the attached tape piece is then peeled at a certain speed in a direction along the paper sheet. The image density was measured by means of a reflection image densitometer (product name: RD914, manufactured by: McBeth Co.) In this fixing test, the minimum temperature of the fixing roll at which the fixing rate of the toner was more than 80%, was defined as the minimum fixing temperature of the toner.

2. Properties of External Additives (1) Calculation of Number Average Particle Diameter For the particles used as the external additives A and B, an SEM image was taken by an ultra-high resolution field emission scanning electron microscope (product name: SU9000, manufactured by: Hitachi High-Technologies Corporation). Of the particles shown on the image, 30 particles were randomly selected. Each of the selected particles was measured for particle diameter, and the number average particle diameter of the 30 particles was calculated.

(2) Measurement of Charge Amount Per Unit Surface Area of External Additives A and B First, 19.98 g of a carrier (product name: N02, manufactured by: Powdertech Corporation) and 0.02 g of the external additive A or B were weighed out and put in a 100 mL polyethylene bottle (inside bottom diameter 23 mm, height 55 mm). The bottle was rotated for 30 minutes at a rotational frequency of 150 rpm by use of a roller mixer. Then, using a blow-off meter (product name: TB-203, manufactured by: Toshiba Chemical Corporation), the blow-off charge amount of the mixture in the bottle was measured by blowing nitrogen gas at a pressure of 2.0 kPa and suctioning the gas at a pressure of 9.5 kPa. The measurement was carried out at a temperature of 23° C. and a relative humidity of 50%.

Using the charge amount (value Q) obtained by the measurement, the charge amount per unit surface area ($\mu C/m^2$) was obtained by the above-described calculation formulae 1 and 2.

3. Properties of Colored Resin Particles (1) Calculation of Number Average Particle Diameter The volume average particle diameter Dv, number average particle diameter Dp and particle size distribution Dv/Dp of the colored resin particles were measured with a particle size distribution measuring device (product name: MULTISIZER, manufactured by: Beckman Coulter, Inc.) The measurement with MULTISIZER was carried out in the following condition.

Aperture diameter: 100 μm

Dispersion medium: ISOTON II (product name)

Concentration: 10%

Number of measured particles: 100,000 particles

More specifically, 0.2 g of the toner sample was put in a beaker. As a dispersant, a surfactant aqueous solution (product name: DRIWEL, manufactured by: Fujifilm Corporation) was added thereto. In addition, 2 mL of the dispersion medium was added to wet the toner. Then, 10 mL of the dispersion medium was added thereto. The mixture was dispersed for one minute with an ultrasonic disperser. Then, the measurement with the above-described particle size measuring device was carried out.

(2) Measurement of Charge Amount Per Unit Surface Area

First, 9.5 g of a carrier (product name: N02, manufactured by: Powdertech Corporation) and 0.5 g of the colored resin particles were weighed out and put in a 30 mL glass bottle (inside bottom diameter 17 mm, height 22 mm). The bottle was rotated for 30 minutes at a rotational frequency of 150 rpm by use of the roller mixer. Then, using the blow-off meter (product name: TB-203, manufactured by: Toshiba Chemical Corporation), the blow-off charge amount of the mixture in the bottle was measured by blowing nitrogen gas at a pressure of 2.0 kPa and suctioning the gas at a pressure of 9.5 kPa. The measurement was carried out at a temperature of 23° C. and a relative humidity of 50%.

Using the charge amount (value Q) obtained by the measurement, the charge amount per unit surface area ($\mu C/m^2$) was obtained by the above-described calculation formulae 3 and 4.

4. Toner Properties (1) Calculation of Coverage of External Additive a on Toner

The coverage of the external additive A on the toner was obtained by the above-described calculation formula 8.

5. Production of Silicone Resin Particles

Production Example 1

First, 60.0 g of water and, as a catalyst, 0.01 g of acetic acid were put in a 200 mL recovery flask and stirred at 30° C. Then, 70.0 g of methyltrimethoxysilane was added thereto. The mixture was stirred for one hour, thereby obtaining a raw material solution.

Next, 3.0 g of 25% aqueous ammonia solution, 128.0 g of water, and 390.0 g of methanol were put in a 1000 mL recovery flask and stirred at 30° C. to prepare an alkaline aqueous medium. To the alkaline aqueous medium, the raw material solution was added in a dropwise manner for one minute. After the addition of the raw material solution, the mixed solution thus obtained was stirred for 25 minutes to develop a polycondensation reaction of a fine particle precursor, thereby obtaining a polycondensation reaction solution.

As an aqueous solution, 3000 g of water was put in a 5000 mL recovery flask. With stirring the water at 25° C., the polycondensation reaction solution was added thereto in a dropwise manner for one minute. The water turned turbid white shortly after it was mixed with the polycondensation reaction solution. Therefore, a dispersion liquid containing silicone particles was obtained.

As a hydrophobizing agent, 30.5 g of hexamethyldisilazane was added to the silicone particle dispersion liquid. As a result of stirring the dispersion liquid at 25° C. for 48 hours, a powder of hydrophobized spherical polymethylsilsesquioxane fine particles floated in the upper part of the liquid, thereby obtaining a powder floating liquid. The liquid was left to stand for 5 minutes to allow the powder to float to the surface. Then, the floating powder was recovered by suction filtration and dried under reduced pressure at 100° C. for 24 hours, thereby obtaining 32 g of a dried powder of negatively-charged silicone resin particles A.

Production Example 2

First, 60.0 g of water and, as a catalyst, 0.01 g of acetic acid were put in a 200 mL recovery flask and stirred at 30° C. Then, 70.0 g of methyltrimethoxysilane was added thereto. The mixture was stirred for one hour, thereby obtaining a raw material solution.

Next, 3.0 g of 25% aqueous ammonia solution, 128.0 g of water, and 390.0 g of methanol were put in a 1000 mL recovery flask and stirred at 30° C. to prepare an alkaline aqueous medium. To the alkaline aqueous medium, the raw material solution was added in a dropwise manner for one minute. After the addition of the raw material solution, the mixed solution thus obtained was stirred for 25 minutes to develop a polycondensation reaction of a fine particle precursor, thereby obtaining a polycondensation reaction solution.

As an aqueous solution, 400 g of water was put in a 5000 mL recovery flask. With stirring the water at 25° C., half amount of the polycondensation reaction solution was added thereto in a dropwise manner for one minute. The water turned turbid white shortly after it was mixed with the polycondensation reaction solution. Therefore, a dispersion liquid containing silicone particles was obtained.

As a hydrophobizing agent, 10.2 g of hexamethyldisilazane was added to the silicone particle dispersion liquid. As a result of stirring the dispersion liquid at 25° C. for 48 hours, a powder of hydrophobized spherical polymethylsilsesquioxane fine particles floated in the upper part of the liquid, thereby obtaining a powder floating liquid. The liquid was left to stand for 5 minutes to allow the powder to float to the surface. Then, the floating powder was recovered by suction filtration and dried under reduced pressure at 100° C. for 36 hours, thereby obtaining 22 g of a dried powder of negatively-charged silicone resin particles B.

6. Toner Production

Example 1

First, 78 parts of styrene and 22 parts of n-butyl acrylate as polymerizable monomers, and 5 parts of carbon black (product name: #25B, manufactured by: Mitsubishi Chemical Corporation) as a black colorant, were dispersed by means of an in-line type emulsifying and dispersing machine (product name: MILDER, manufactured by: Pacific Machinery & Engineering Co., Ltd.), thereby obtaining a polymerizable monomer mixture.

To the polymerizable monomer mixture, 1.0 part of a charge control resin (a quaternary ammonium group-containing styrene acrylic resin) as a charge control agent, 5.0 parts of a fatty acid ester wax (behenyl behenate) as a release agent, 0.3 parts of a polymethacrylic acid ester macromonomer (product name: AA6, manufactured by: Toagosei Co., Ltd.) as a macromonomer, 0.6 parts of divinylbenzene as a crosslinkable polymerizable monomer, and 1.6 parts of t-dodecyl mercaptan as a molecular weight modifier, were added. They were mixed and dissolved to prepare a polymerizable monomer composition.

Separately, an aqueous solution of 7.2 parts of sodium hydroxide (alkali metal hydroxide) dissolved in 50 parts of ion-exchanged water, was gradually added to an aqueous solution of 12.2 parts of magnesium chloride (water-soluble polyvalent metal salt) dissolved in 250 parts of ion-exchanged water, while stirring at room temperature, thereby preparing a magnesium hydroxide colloid (hardly water-soluble metal hydroxide colloid) dispersion.

A suspension thus obtained in which the droplets of the polymerizable monomer composition were dispersed (a polymerizable monomer composition dispersion) was put in a reactor furnished with stirring blades, and the temperature thereof was increased to 90° C. to initiate a polymerization reaction. When a polymerization conversion rate reached almost 100%, 1 part of methyl methacrylate as a polymerizable monomer for shell, and 0.3 parts of 2,2'-azobis(2-methyl-N-(2-hydroxyethyl)-propionamide) (product name: VA-086, manufactured by: Wako Pure Chemical Industries, Ltd., water-soluble) as a polymerization initiator for shell, which was dissolved in 10 parts of ion-exchanged water, were added to the reactor. The reaction was continued for 4 hours at 90° C. Then, the reaction was stopped by water-cooling the reactor, thereby obtaining an aqueous dispersion of colored resin particles having a core-shell type structure.

The aqueous dispersion of the colored resin particles was subjected to acid washing by, while agitating the aqueous dispersion at room temperature, adding sulfuric acid in a dropwise manner until the pH of the aqueous dispersion reached 6.5 or less. Next, the aqueous dispersion was subjected to filtration separation. Then, a solid matter thus obtained was mixed with 500 parts of ion-exchanged water, re-slurried, repeatedly subjected to a water washing treatment (washing, filtering and dehydrating) several times, and then subjected to filtration separation. A solid matter thus obtained was put in the container of a dryer and dried at 45° C. for 48 hours, thereby obtaining dried colored resin particles. For the obtained colored resin particles, the volume average particle diameter (Dv) was 9.7 μm; the number average particle diameter (Dn) was 7.5 μm; the particle size distribution (Dv/Dn) was 1.13; and the average circularity was 0.987.

To 100 parts of the colored resin particles obtained above, 3.0 parts of positively-charged strontium titanate particles being surface-hydrophobized with aminosilane, having a number average particle diameter of 35 nm and having a surface charge amount of 111 $\mu C/m^2$ as the external additive A and 0.5 parts of the silicone resin particles A obtained in Production Example 1 as the external additive B, were added. Using a high-speed mixer (product name: FM MIXER, manufactured by: Nippon Coke & Engineering Co., Ltd.), they were mixed and stirred at a peripheral speed of 40 m/s for 10 minutes to add the external additives on the colored resin particles, thereby obtaining the toner of Example 1.

Examples 2 to 8 and Comparative Examples 1 to 5

Toners of Examples 2 to 8 and Comparative Examples 1 to 5 were produced in the same manner as Example 1, except that the types and/or amounts of the external additives were changed as shown in Tables 1 and 2.

5. Overall Evaluation of Toners

Table 1 shows the properties and evaluation results of the toners of Examples, the properties of the colored resin particles, and the properties of the external additives. Table 2 shows the properties and evaluation results of the toners of Comparative Examples, the properties of the colored resin particles, and the properties of the external additives. Hereinafter, "surface charge amount" indicates "charge amount per unit surface area".

TABLE 1

| | Example 1 | Example 2 | Example 3 | Example 4 | Example 5 | Example 6 | Example 7 | Example 8 |
|---|---|---|---|---|---|---|---|---|
| External additive A | Strontium titanate | Strontium titanate | Strontium titanate | Strontium titanate | Aluminum oxide | Aluminum oxide | Strontium titanate | Strontium titanate |
| Number average particle diameter (nm) | 35 | 35 | 35 | 35 | 20 | 20 | 35 | 35 |
| Density ($g/cm^3$) | 5.1 | 5.1 | 5.1 | 5.1 | 4.0 | 4.0 | 5.1 | 5.1 |
| Surface charge amount ($\mu C/m^2$) | 111 | 111 | 111 | 111 | 80 | 80 | 111 | 111 |
| Surface charge amount ratio (External additive A/ Colored resin particles) | 1.27 | 1.27 | 1.27 | 1.27 | 0.91 | 0.91 | 1.27 | 1.27 |
| Coverage (%) | 42 | 28 | 56 | 42 | 63 | 94 | 42 | 42 |
| Amount (parts) | 3.0 | 2.0 | 4.0 | 3.0 | 1.5 | 2.5 | 3.0 | 3.0 |
| External additive B | Silicone resin particles A | Silicone resin particles A | Silicone resin particles A | Silicone resin particles B | Silicone resin particles A | Silicone resin particles A | Silicone resin particles A | Silicone resin particles A |
| Number average particle diameter (nm) | 90 | 90 | 90 | 130 | 90 | 90 | 90 | 90 |

TABLE 1-continued

| | Example 1 | Example 2 | Example 3 | Example 4 | Example 5 | Example 6 | Example 7 | Example 8 |
|---|---|---|---|---|---|---|---|---|
| Density (g/cm$^3$) | 1.3 | 1.3 | 1.3 | 1.3 | 1.3 | 1.3 | 1.3 | 1.3 |
| Form | Spherical | Spherical | Spherical | Spherical | Spherical | Spherical | Spherical | Spherical |
| Theoretical specific surface area (TS) (m$^2$/g) | 50 | 50 | 50 | 35 | 50 | 50 | 50 | 50 |
| BET specific surface area (BS) (m$^2$/g) | 230 | 230 | 230 | 222 | 230 | 230 | 230 | 230 |
| BS/TS | 4.6 | 4.6 | 4.6 | 6.3 | 4.6 | 4.6 | 4.6 | 4.6 |
| Water adsorption amount (%) | 0.24 | 0.24 | 0.24 | 0.33 | 0.24 | 0.24 | 0.24 | 0.24 |
| Surface charge amount (μC/m$^2$) | −20 | −20 | −20 | −20 | −20 | −20 | −20 | −20 |
| Surface charge amount ratio (External additive B/ Colored resin particles) | −0.23 | −0.23 | −0.23 | −0.23 | −0.23 | −0.23 | −0.23 | −0.23 |
| Coverage (%) | 6 | 6 | 6 | 4 | 6 | 6 | 6 | 6 |
| Amount (parts) | 0.3 | 0.3 | 0.3 | 0.3 | 0.3 | 0.3 | 0.1 | 0.5 |
| Type of colored resin particles | Positively charged | Positively charged | Positively charged | Positively charged | Positively charged | Positively charged | Positively charged | Positively charged |
| Surface charge amount (μC/m$^2$) of colored resin particles | 88 | 88 | 88 | 88 | 88 | 88 | 88 | 88 |
| Amount (parts) | 100 | 100 | 100 | 100 | 100 | 100 | 100 | 100 |
| Volume average particle diameter Dv (μm) of toner | 7.8 | 7.8 | 7.8 | 7.8 | 7.8 | 7.8 | 7.8 | 7.8 |
| Type of toner | Positively charged | Positively charged | Positively charged | Positively charged | Positively charged | Positively charged | Positively charged | Positively charged |
| Minimum fixing temperature (° C.) | 150 | 145 | 155 | 150 | 150 | 155 | 145 | 155 |
| Printing durability (sheets) | 20000< | 20000< | 20000< | 20000< | 20000< | 20000< | 20000< | 20000< |
| Actual device charge amount (μC/g) before printing durability test | 41.6 | 38.7 | 42.3 | 37.9 | 31.5 | 33.1 | 31.5 | 49.7 |
| Actual device charge amount (μC/g) after printing 10,000 sheets | 43.5 | 32.6 | 45.6 | 38.2 | 25.9 | 27.4 | 32.2 | 53.2 |
| Charge stability during printing durability test | A | B | A | A | B | B | A | A |
| Solid pattern followability | 0.0 | 0.0 | 0.1 | 0.2 | 0.2 | 0.3 | 0.2 | 0.0 |
| Supply solid pattern followability | 0.1 | 0.0 | 0.1 | 0.3 | 0.2 | 0.4 | 0.2 | 0.4 |
| Ejection | A | B | A | A | B | B | B | A |
| Supply ejection | A | B | B | A | C | C | B | C |

TABLE 2

| | Comparative Example 1 | Comparative Example 2 | Comparative Example 3 | Comparative Example 4 | Comparative Example 5 |
|---|---|---|---|---|---|
| External additive A | Strontium titanate | — | Silica particles (TG7120) | Silica particles (H05TA) | Negatively-charged silica particles (TG-7180) |

TABLE 2-continued

| | Comparative Example 1 | Comparative Example 2 | Comparative Example 3 | Comparative Example 4 | Comparative Example 5 |
|---|---|---|---|---|---|
| Number average particle diameter (nm) | 35 | — | 20 | 50 | 20 |
| Density (g/cm$^3$) | 5.1 | — | 2.2 | 2.2 | 2.2 |
| Surface charge amount (μC/m$^2$) | 111 | — | 27 | 64 | −22 |
| Surface charge amount ratio (External additive A/ Colored resin particles) | 1.27 | — | 0.31 | 0.73 | −0.25 |
| Coverage (%) | 42 | — | 46 | 34 | 46 |
| Amount (parts) | 3 | — | 0.8 | 1.5 | 0.8 |
| External additive B | — | Silicone resin particles A | Silicone resin particles A | Silicone resin particles A | Silicone resin particles A |
| Number average particle diameter (nm) | — | 90 | 90 | 90 | 90 |
| Density (g/cm$^3$) | — | 1.3 | 1.3 | 1.3 | 1.3 |
| Form | — | Spherical | Spherical | Spherical | Spherical |
| Theoretical specific surface area (TS) (m$^2$/g) | — | 50 | 50 | 50 | 50 |
| BET specific surface area (BS) (m$^2$/g) | — | 230 | 230 | 230 | 230 |
| BS/TS | — | 4.6 | 4.6 | 4.6 | 4.6 |
| Water adsorption amount (%) | — | 0.24 | 0.24 | 0.24 | 0.24 |
| Surface charge amount (μC/m$^2$) | — | −20 | −20 | −20 | −20 |
| Surface charge amount ratio (External additive B/ Colored resin particles) | — | — | −0.23 | −0.23 | −0.23 |
| Coverage (%) | — | 6 | 6 | 6 | 6 |
| Amount (parts) | — | 0.3 | 0.3 | 0.3 | 0.3 |
| Type of colored resin particles | Positively charged | Positively charged | Positively charged | Positively charged | Positively charged |
| Surface charge amount (μC/m$^2$) of colored resin particles | 88 | 88 | 88 | 88 | 88 |
| Amount (parts) | 100 | 100 | 100 | 100 | 100 |
| Volume average particle diameter Dv (μm) of toner | 7.8 | 7.8 | 7.8 | 7.8 | 7.8 |
| Type of toner | Positively charged | Positively charged | Positively charged | Positively charged | Positively charged |
| Minimum fixing temperature (° C.) | 145 | 140 | 150 | 155 | 150 |
| Printing durability (sheets) | 5000 | 0 | 11000 | 15000 | 0 |
| Actual device charge amount (μC/g) before printing durability test | 15.5 | — | 34.7 | 30.1 | — |
| Actual device charge amount (μC/g) after printing 10,000 sheets | — | — | 10.3 | 16.2 | — |

TABLE 2-continued

| | Comparative Example 1 | Comparative Example 2 | Comparative Example 3 | Comparative Example 4 | Comparative Example 5 |
|---|---|---|---|---|---|
| Charge stability during printing durability test | — | Non-evaluable | D | C | Non-evaluable |
| Solid pattern followability | 0.1 | Non-evaluable | 0.2 | 0.6 | Non-evaluable |
| Supply solid pattern followability | 0.6 | Non-evaluable | 0.7 | 1.0 | Non-evaluable |
| Ejection | D | D | A | A | D |
| Supply ejection | D | Non-evaluable | D | D | Non-evaluable |

The toner of Comparative Example 1 is the toner in which the ratio of the charge amount per unit surface area of the strontium titanate to that of the colored resin particles was 1.27, was used as the external additive A, and the external additive B was not used. The toner of Comparative Example 1 had no problem with the evaluation results for "minimum fixing temperature" and "solid pattern followability".

However, for "ejection", the evaluation result was D and poor. For "printing durability", the number of the sheets was 5,000 and small. For "supply solid pattern followability", the evaluation result was 0.6 and high. For "supply ejection" after the printing durability test, the evaluation result was D and poor.

Therefore, it was revealed that even in the case of using strontium titanate as the external additive A, the toner in which the external additive A is used alone, is poor in ejection, printing durability, supply solid pattern followability, and supply ejection after the printing durability test.

The toner of Comparative Example 2 is the toner in which the silicone resin particles A having a number average particle diameter of 90 nm were used as the external additive B, and the external additive A was not used. The toner of Comparative Example 2 had no problem with the minimum fixing temperature. However, for the evaluation items other than "minimum fixing temperature", the evaluation results were substandard and poor.

Therefore, it was revealed that even in the case of using the silicone resin particles A as the external additive B, the toner in which the external additive B is used alone, is poor in printing durability, charge stability during the printing durability test, ejection, supply solid pattern followability, ejection, and supply ejection after the printing durability test.

The toner of Comparative Example 3 is the toner in which the ratio of the charge amount per unit surface area of the silica particles to that of the colored resin particles was 0.31, were used as the external additive A, and the silicone resin particles A having a number average particle diameter of 90 nm were used as the external additive B. The toner of Comparative Example 3 had no problem with the evaluation results for "minimum fixing temperature", "solid pattern followability" and "ejection".

However, for "printing durability", the number of the sheets was 11,000 and small. For "charge stability during printing durability test", the evaluation result was D and poor. For "supply solid pattern followability", the evaluation result was 0.7 and high. For "supply ejection" after the printing durability test, the evaluation result was D and poor.

Therefore, it was revealed that the toner in which the ratio of the charge amount per unit surface area of the silica particles to that of the colored resin particles is 0.31, are used as the external additive A and the silicone resin particles A having a number average particle diameter of 90 nm are used as the external additive B, is poor in printing durability, charge stability during printing durability test, supply solid pattern followability, and supply ejection after the printing durability test.

The toner of Comparative Example 4 is the toner in which the ratio of the charge amount per unit surface area of the silica particles to that of the colored resin particles was 0.73, were used as the external additive A, and the silicone resin particles A having a number average particle diameter of 90 nm were used as the external additive B. The toner of Comparative Example 4 had no problem with the evaluation results for "minimum fixing temperature" and "ejection".

However, for "printing durability", the number of the sheets was 15,000 and small. The solid pattern followability was 0.6 and high. For "charge stability during printing durability test", the evaluation result was D and poor. For "supply solid pattern followability", the evaluation result was 1.0 and high. For "supply ejection" after the printing durability test, the evaluation result was D and poor.

Therefore, it was revealed that the toner in which the ratio of the charge amount per unit surface area of the silica particles to that of the colored resin particles is 0.73, are used as the external additive A and the silicone resin particles A having a number average particle diameter of 90 nm are used as the external additive B, is poor in printing durability, solid pattern followability, charge stability during printing durability test, supply solid pattern followability, and supply ejection after the printing durability test.

The toner of Comparative Example 5 is the toner in which the ratio of the charge amount per unit surface area of the silica particles to that of the colored resin particles was −0.25 (that is, the silica particles were charged to the opposite polarity to the polarity of the colored resin particles) were used, and the silicone resin particles A having a number average particle diameter of 90 nm were used as the external additive B. The toner of Comparative Example 5 had no problem with the minimum fixing temperature. However, for the evaluation items other than "minimum fixing temperature", the evaluation results were substandard and poor.

Therefore, it was revealed that the toner in which the ratio of the charge amount per unit surface area of the silica particles to that of the colored resin particles is −0.25 (that is, the silica particles are charged to the opposite polarity to the polarity of the colored resin particles) are used and the silicone resin particles A having a number average particle diameter of 90 nm are used as the external additive B, is poor in printing durability, charge stability during printing durability test, ejection, supply solid pattern followability, ejection, and supply ejection after the printing durability test.

Meanwhile, the toners of Examples 1 to 8 are each a toner comprising the external additives A and B, wherein the external additive A was the metal oxide particles charged to the same polarity as the polarity of the colored resin particles; the ratio of the charge amount per unit surface area of the external additive A to that of the colored resin particles was 0.85 or more; and the number average particle diameter of the metal oxide particles was from 20 nm to 35 nm, and wherein the external additive B was the silicone resin particles having a number average particle diameter of from 90 nm to 130 nm. Also, each of the toners of Examples 1 to 8 contained, with respect to 100 parts of the colored resin particles, the external additive A in an amount of from 1.5 parts to 4.0 parts and the external additive B in an amount of from 0.1 parts to 0.5 parts.

For the toners of Examples 1 to 8, the minimum fixing temperature was 155° C. or less and low; slight ejection that ended during printing of up to 3 sheets, was only confirmed; for "printing durability", the number of the sheets was 20,000 or more and large; and the solid pattern followability value was 0.3 or less and small.

Even in the case of supplying the toner, supply solid pattern followability was 0.4 or less and low. For "supply ejection" after the printing durability test, slight ejection that did not end during printing of up to 100 sheets, was only confirmed.

Therefore, it was revealed that the toners of Examples 1 to 8, each of which is the toner for developing electrostatic images, comprising the colored resin particles that comprise the binder resin, the colorant and the charge control agent, and the external additives, wherein the external additives contain at least the external additive A and the external additive B; wherein the external additive A is the metal oxide particles charged to the same polarity as the polarity of the colored resin particles; the ratio of the charge amount per unit surface area of the external additive A to that of the colored resin particles is 0.85 or more; and the number average particle diameter of the metal oxide particles is from 5 nm to 100 nm; wherein the external additive B is the resin particles charged to the opposite polarity to the polarity of the colored resin particles, and the number average particle diameter of the resin particles is from 50 nm to 1000 nm; and wherein, with respect to 100 parts by mass of the colored resin particles, the content of the external additive A is from 0.5 parts by mass to 6.0 parts by mass, and the content of the external additive B is from 0.1 parts by mass to 2.0 parts by mass, are excellent in printing durability and are less likely to cause supply aggregation.

The invention claimed is:

1. A toner for developing electrostatic images, comprising colored resin particles that comprise a binder resin, a colorant and a charge control agent, and external additives, wherein the external additives contain at least an external additive A and an external additive B;

wherein the external additive A is metal oxide particles charged to the same polarity as a polarity of the colored resin particles; a ratio of a charge amount per unit surface area of the external additive A to that of the colored resin particles is 0.85 or more; and a number average particle diameter of the metal oxide particles is from 5 nm to 100 nm;

wherein the external additive B is resin particles charged to the opposite polarity to the polarity of the colored resin particles, and a number average particle diameter of the resin particles is from 50 nm to 1000 nm; and wherein, with respect to 100 parts by mass of the colored resin particles, a content of the external additive A is from 0.5 parts by mass to 6.0 parts by mass, and a content of the external additive B is from 0.1 parts by mass to 2.0 parts by mass.

2. The toner for developing electrostatic images according to claim 1, wherein the colored resin particles are positively charged.

3. The toner for developing electrostatic images according to claim 1, wherein a coverage of the external additive A on the toner is from 20% to 100%.

4. The toner for developing electrostatic images according to claim 1, wherein the external additive A is titanate or aluminum oxide.

5. The toner for developing electrostatic images according to claim 1, wherein the external additive B is silicone resin particles.

* * * * *